United States Patent [19]

Hinton et al.

[11] 4,247,743

[45] Jan. 27, 1981

[54] DEVICE FOR PREVENTING UNAUTHORIZED USAGE OF APPLIANCE

[76] Inventors: David O. Hinton, 4700 Hiddenbrook Dr., Raleigh, N.C. 27609; David T. Mage, 2012 S. Lakeshore Dr., Chapel Hill, N.C. 27514

[21] Appl. No.: 83,472

[22] Filed: Oct. 10, 1979

[51] Int. Cl.[3] ..... H01H 9/28

[52] U.S. Cl. ..... 200/44; 200/51 R

[58] Field of Search ..... 307/112, 114; 200/42 R, 200/44, 51 R

[56] References Cited

U.S. PATENT DOCUMENTS

| | | | |
|---|---|---|---|
| 2,217,585 | 10/1940 | Yates | 200/51 R |
| 2,846,530 | 8/1958 | Wintriss | 200/51 R |
| 2,856,474 | 10/1958 | Norris | 200/44 |
| 2,907,855 | 10/1959 | Hedges | 307/112 |
| 3,524,029 | 8/1970 | Laff | 200/51 R |
| 4,063,110 | 12/1977 | Glick | 200/44 |
| 4,167,658 | 9/1979 | Sherman | 200/51 R |

FOREIGN PATENT DOCUMENTS

| | | | |
|---|---|---|---|
| 574264 | 3/1958 | Italy | 200/51 R |

*Primary Examiner*—John W. Shepperd
*Attorney, Agent, or Firm*—Mills & Coats

[57] ABSTRACT

The present invention relates to a device that prevents unauthorized use of an appliance inasmuch as the unauthorized use results in clear evidence of such. Basically the device of the present invention comprises an electrical coupler having means for receiving a male appliance plug and male plug means for insertion into a conventional electrical outlet. A flexible tie device is provided that binds and effectively locks the male appliance plug to the electrical coupler in such a manner that the male appliance plug cannot be removed from the electrical coupler without destroying the integrity of the flexible tie device. In addition, a lock type switch is operatively associated with said electrical coupler for opening and closing the electrical circuit therein and as such, the same provides a master control for a coupled appliance.

6 Claims, 5 Drawing Figures

DEVICE FOR PREVENTING UNAUTHORIZED USAGE OF APPLIANCE

The present invention relates to electrical connectors, and more particularly to electrical connectors and devices that prevent and/or control the unauthorized use of appliances.

BACKGROUND OF INVENTION

In the prior art, there has been provided means for preventing the unauthorized use of appliances such as televisions, etc., and for a general appreciation of the state of the art in this area one is referred to U.S. Pat. Nos. 3,524,029 and 4,063,110. In both of these patents, the structure utilized to accomplish the desired result of protecting against unauthorized use entails the provision of a lock box to or from which the appliance male plug extends. While such devices may be effective to achieve the end result desired, they are nevertheless large and often bulky, unsightly, and expensive.

Often such devices as referred to above are utilized in commercial installations as security devices. But beyond this, there is a need for such type devices even in the home. One example is where a parent wishes to be assured that his or her child does not watch television during certain periods when the parent is going to be absent from the home. In such cases, it is desirable for the parent to be able to effectively lock the television and accordingly prevent its usage for a period desired. This can be provided by a device such as that shown in U.S. Pat. No. 4,063,110. But the disadvantages of such are apparent inasmuch as the device is large and bulky, expensive, and would generally be required to be placed or stored behind the appliance where the same could not be easily seen.

Therefore, it is appreciated that there is a need for a relatively simple, small and inexpensive device that will effectively lock the selected appliance for a period of time and prevent the unauthorized use of such.

SUMMARY OF INVENTION

The present invention entails an electrical coupling device that is adapted to be connected between a male appliance plug and a conventional wall outlet. In particular, the present invention does not utilize the lock box security concept, but is provided with a simple, flexible tying device that ties and locks the male appliance plug to the electrical coupling device such that the male appliance plug cannot be removed therefrom without destroying the integrity of the tying device. In addition, the electrical coupling device is provided with a locking switch of the key cylinder type that allows for the electrical circuit extending therethrough to be locked in an open position in order that current cannot reach the appliance.

It is, therefore, an object of the present invention to provide a security type electrical coupler that will effectively prevent a coupled appliance from unauthorized use and which is reliable, effective, neat and compact, and relatively simple and inexpensive.

A further object of the present invention is to provide an electrical security coupler of the character described above that includes a flexible disposable tying device that securely locks the male appliance plug to the electrical coupler and which is designed such that the removal of the flexible tying device from its tied position results in the integrity of the tying device being completely destroyed and would accordingly prevent the reuse of the same tying device.

Still a further object of the present invention relates to a security type electrical coupler of the character described above wherein the electrical coupler includes a master lock type switch for controlling the actuation of the coupled appliance wherein the lock type switch can be extended to numerous areas around and adjacent the coupled appliance for convenient actuation.

Another object of the present invention is to provide a security type electrical coupler of the type referred to above wherein the locking switch utilizes a key type lock wherein the circuit of the electrical coupler can be locked in an open position and the key removed.

Other objects and advantages of the present invention will become apparent from a study of the following description and the accompanying drawings which are merely illustrative of the present invention.

DESCRIPTION OF PREFERRED EMBODIMENT

Figure 1:
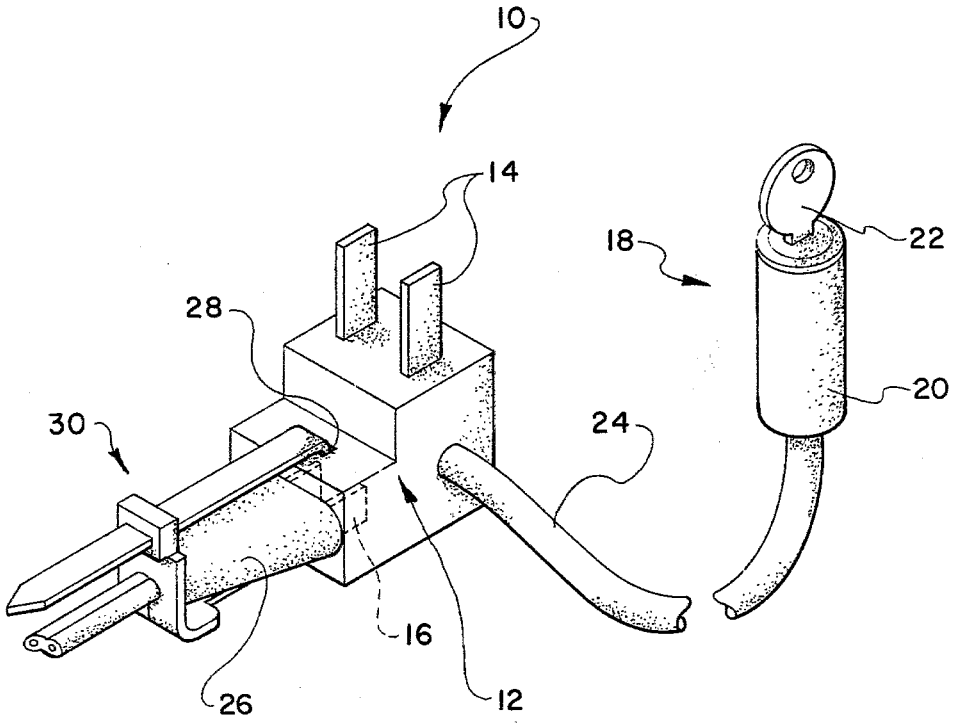
FIG. 1 is a perspective view of the electrical connecting device for preventing unauthorized usage of an appliance.
Figure 2:
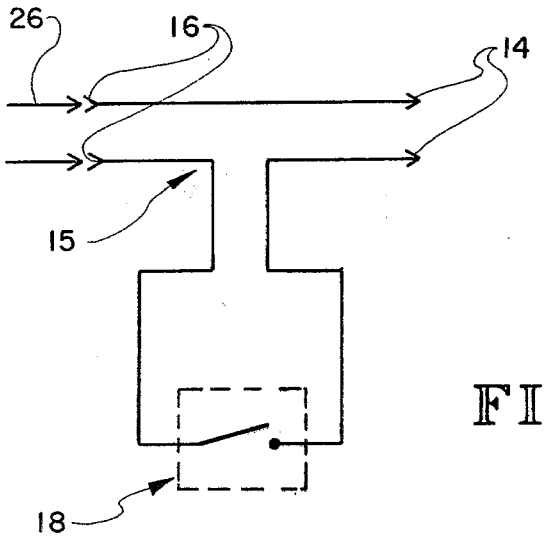
FIG. 2 is an electrical schematic illustrating the present invention.

With further reference to the drawings, the present invention in the form of means for preventing unauthorized use of a selected appliance is shown therein and indicated generally by the numeral 10. The device or apparatus forming the means for preventing unauthorized use of an appliance comprises an electrical coupler indicated generally by the numeral 12, the coupler 12 including a male plug means 14 adapted to be connected into a conventional wall outlet and female plug receiving means 16. Between female plug receiving means 16 and male plug means 14 of electrical coupler 12, there is provided an electrical circuit 15 (FIG. 2) that allows current to be transferred therebetween.

Operatively associated with electrical coupler 12 is a combination switch and lock means indicated generally by the numeral 18. Switch and lock means 18 comprises a cylinder lock 20 having a removable key 22 associated therewith, and extending from the cylinder lock 20 is a line 24 that connects to the electrical coupler 12 and particularly to circuit 15 therein. Details of the combination switch and lock means are not dealt with herein because such is known in the art. Suffice it to say that the switch portion is connected into the electrical circuit 15 of the electrical coupler 12 and key 22 is operative to open and close the switch. Therefore, it is appreciated that in one position the switch will be open and the key 22 could be removed, thereby preventing current from being directed between male plug 14 and female plug receiving means 16 of the electrical coupler 12. Further, key 22 may be inserted into lock cylinder 20 and turned to a closed position thereby allowing current to freely flow from male plug 14 to female receiving plug 16 of electrical coupler 12.

Electrical coupler 12 is adapted to receive a male appliance plug 26 from any selected appliance such as a television or the like.

Forming a part of the present invention and the apparatus and device for preventing unauthorized use of an appliance, there is provided a flexible tie coupler 30 that is adapted to tie and connect appliance male plug 26 to the electrical coupler 12 in such a manner that the appliance male plug 26 cannot be removed therefrom without destroying the integrity of the tie coupler 30.

Figure 3:
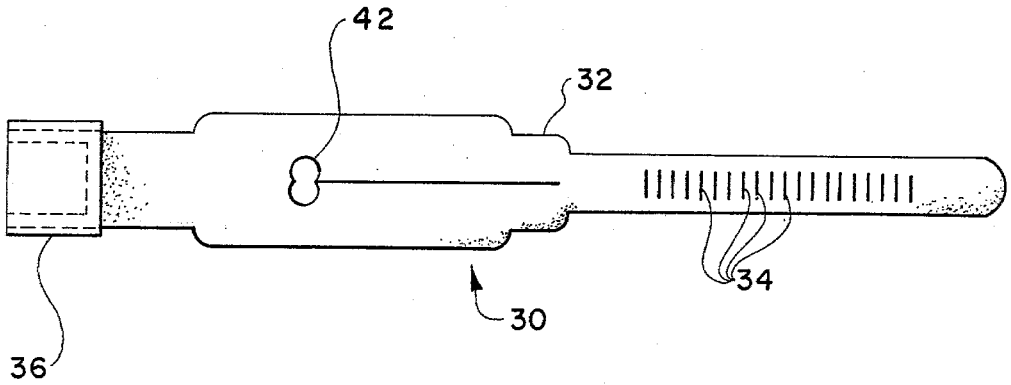
FIG. 3 is a bottom plan view of the tie coupler forming a part of the present invention.
Figure 4:
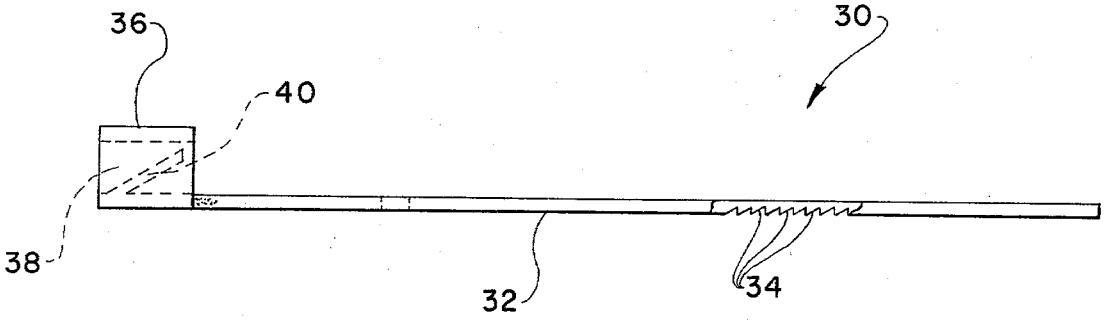
FIG. 4 is a side elevational view of the tie coupler shown in FIG. 3.

Viewing the tie coupler 30 in more detail, it is seen that one embodiment illustrated in FIGS. 3–4 includes a flexible tongue portion 32 in which at least a portion thereof includes a series of transversely aligned teeth 34 disposed on one side thereof. In addition, the tongue portion includes a division or slit 42 that will enable the tongue portion to straddle and generally encompass appliance male plug 26. This will be clearer from subsequent portions of this disclosure.

In addition, tie coupler 30 includes a locking receiver portion 36 disposed about one end thereof and locking receiver 36 includes an opening 38 in which the remote end of tongue portion 32 can be threaded therethrough, and further includes a latching tooth 40 that is oriented within opening 38 so as to engage the respective teeth 34 of tongue 32 so as to create and define a ratchet type locking design. Once latching tooth 40 engages one of the teeth 34, the tongue portion 32 cannot be reversed and pulled from the locking receiver 36.

In use, the electrical coupler 12 would be provided with an opening for receiving the tongue portion 32 of the tie coupler 30. The opening could be an external opening formed about the outside of the coupler 12, or as suggested in the embodiment illustrated in FIGS. 1–4 the portion of the electrical coupler 12 adjacent the female plug receiving means 16 is formed with an intermediate opening 28 formed entirely therthrough so as to allow the tongue portion 32 of the tie coupler 30 to be threaded therethrough. In this regard, appliance plug 26 would be inserted through the division or slit 42 formed in the tongue portion 32 of the tie coupler 32 prior to being inserted into the female plug receiving means 16 of the coupler 12. Once appliance plug 26 is inserted through division or slit 42, the appliance plug 26 is inserted into the electrical coupler 12 and then the remote end of the tongue portion 32 is inserted through the opening 28 within the electrical coupler 12 and directed back to the locking receiver 36 of the tie coupler 30. Next the tongue is threaded through opening 38 of the locking receiver 36 and pulled tight such that the area of the tongue portion 32 adjacent the division or slit 42 straddles the appliance male plug 26 and holds the same adjacent the female plug receiving means 16 of the electrical coupler 12. Because of the nature of teeth 34 and the latching tooth 40, the tongue portion 32 cannot be reversed and pulled out the locking receiver 36 in a direction opposite the direction of insertion therein. This means that the appliance male plug 26 cannot be removed from the electrical coupler 12 without cutting or destroying the integrity of the tie coupler 30.

Consequently, this allows one to prevent or control the use of the coupled appliance by actuating the combination switch and lock means 18.

Figure 5:
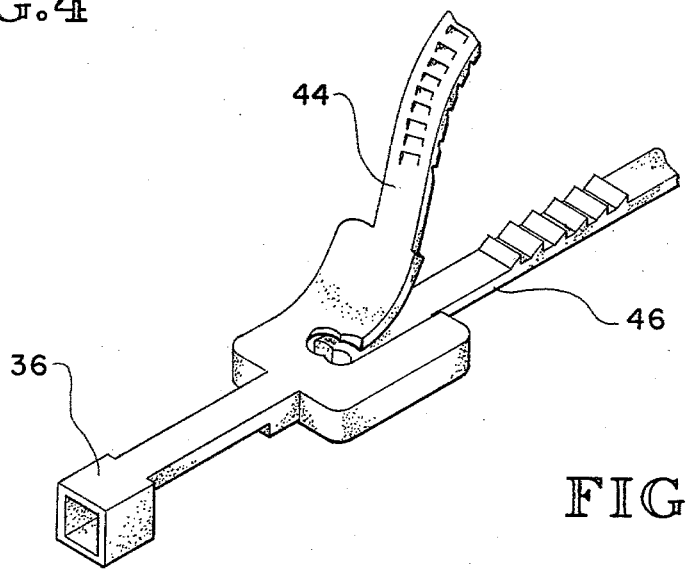
FIG. 5 is a fragmentary perspective view of an alternate design for the tie coupler.

In the embodiment just described and shown in FIGS. 1–4, the division or slit 42 was formed vertically in the tongue portion 32. A contemplated alternate embodiment is illustrated in FIG. 5 and in this case the slit or division is horizontal inasmuch as the tongue portion is cut or divided into upper and lower sections 44 and 46. Here as shown, the respective upper and lower sections about their inner faces comprise cooperating teeth that allow the respective sections to be merged together and held generally stationary once the merged tongue section is threaded through the locking receiver 36. Upper and lower sections 44 and 46 serve essentially the same purpose as the slit or division 42 described hereinabove inasmuch as the two sections can be directed around opposite sides of the appliance male plug 26 so as to retain and hold the same adjacent the coupler 12 in such a manner that the appliance plug 26 cannot be removed therefrom without destroying the tie coupler 30 or the integrity thereof.

From the foregoing specification and discussion, it is appreciated that the device or apparatus of the present invention that prevents the unauthorized use of an appliance is relatively simple and inexpensive as compared to the prior art, especially since the tie coupler 30 could be constructed of a plastic material and could be disposed once disassociated or disconnected from a coupled relationship. In addition, the apparatus or device of the present invention gives the advantage of being able to prevent and control the use of appliances and is suited for both domestic and commercial use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A means for detecting the unauthorized use of an appliance having an AC male plug associated therewith, comprising: electrical coupling means for plugging into a conventional wall outlet and including male plug means adapted to be connected into said wall outlet and female receiving means for receiving the male plug of said appliance, said electrical coupling means including an electrical circuit operatively interconnected between said male plug means and said female receiving means thereof; switch means operatively connected between said male plug means and said female receiving means of said electrical coupling means for selectively opening and closing the circuit therebetween, said switch means having locking means associated therewith for selectively locking said switch means in an open position so as to prevent the conduction of current between said male plug means and said female receiving means of said electrical coupling means; and flexible tie coupling means operatively engaged with said appliance male plug and said electrical coupling means and generally bound therearound for maintaining said male plug of said appliance in locked engagement with said electrical coupling means, said tie coupling means including irreversible tie means that may not be disengaged and reengaged without destroying the integrity of the tie coupling means, whereby the actuating of said appliance is controlled by the switch and lock means associated with said electrical coupling means.

2. The device of claim 1 wherein said tie coupling means includes an elongated flexible tying device that comprises an elongated tongue having a series of transversely spaced teeth extending therealong on one side and a ratchet locking receiver having a tooth type latch formed therein, and wherein said tongue is adapted to be threaded through said ratchet locking receiver such that the tooth type latch engages an adjacent tooth on said tongue and prohibits the tongue from being reversed and pulled back out of said ratchet locking receiver, such that when the tongue is securely locked within the ratchet locking receiver the flexible tie coupling means forms a closed locked loop; and wherein the tongue portion of said flexible tongue device is divided such that the same may extend around opposite sides of the male plug of said appliance, and wherein said electrical coupling means is provided with an opening for receiving said flexible tying device such that in a tyed and locked position the flexible tying device extends around said appliance male plug and through said opening within said electrical coupling means.

3. The device of claim 2 wherein said division within said tongue extends vertically through said tongue about an intermediate portion thereof.

4. The device of claim 3 wherein said locking means comprises a cylinder type lock assembly operatively associated with said switch means of said electrical coupler means for actuating the switch between open and closed position.

5. The device of claim 2 wherein said division within said tongue is provided by upper and lower tongue sections that are adapted to be separated in order that the two sections may be appropriately directed around the male plug of said appliance, and wherein said upper and lower tongue sections are further adapted to merge together after being directed around said male plug of said appliance where the two tongue sections may be threaded through said opening within said electrical coupling means and on through said ratchet locking device of said flexible tying device.

6. The device of claim 5 wherein said two sections include cooperating interengaging teeth about inner adjacent faces of each such that when the two sections are laid together and merged the two sections are held relatively stationary to each.

* * * * *